US009581115B2

(12) United States Patent
Moyer et al.

(10) Patent No.: US 9,581,115 B2
(45) Date of Patent: Feb. 28, 2017

(54) INDUCTION SYSTEM INCLUDING A PASSIVE-ADSORPTION HYDROCARBON TRAP

(71) Applicant: Ford Global Technologies, LLC, Dearborn, MI (US)

(72) Inventors: David S. Moyer, Sterling Heights, MI (US); Roger Joseph Khami, Troy, MI (US); Douglas Scott Sparks, West Bloomfield, MI (US); Brian F. VanderHaagen, Dexter, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/841,571

(22) Filed: Aug. 31, 2015

(65) Prior Publication Data

US 2015/0369183 A1 Dec. 24, 2015

Related U.S. Application Data

(63) Continuation-in-part of application No. 13/456,615, filed on Apr. 26, 2012, now Pat. No. 9,121,373.

(60) Provisional application No. 61/606,267, filed on Mar. 2, 2012.

(51) Int. Cl.

| | |
|---|---|
| ***F02M 25/08*** | (2006.01) |
| ***F02M 35/02*** | (2006.01) |
| ***F02M 35/104*** | (2006.01) |
| ***F02M 33/04*** | (2006.01) |
| *F02M 37/22* | (2006.01) |

(52) U.S. Cl.

CPC ..... *F02M 35/0218* (2013.01); *F02M 33/04* (2013.01); *F02M 35/104* (2013.01); *F02M 25/0854* (2013.01); *F02M 37/22* (2013.01)

(58) Field of Classification Search

CPC .... F02M 35/00; F02M 35/02; F02M 35/0218; F02M 25/0854; F02M 25/089

USPC ..... 123/516, 198 E

See application file for complete search history.

(56) References Cited

U.S. PATENT DOCUMENTS

| | | | |
|---|---|---|---|
| 5,207,734 | A | 5/1993 | Day et al. |
| 5,505,769 | A | 4/1996 | Dinnage et al. |
| 6,692,551 | B2 | 2/2004 | Wernholm et al. |
| 6,905,536 | B2 | 6/2005 | Wright |
| 6,913,001 | B2 | 7/2005 | Abdolhosseini et al. |
| 6,997,977 | B2 | 2/2006 | Dallas et al. |
| 7,077,891 | B2 | 7/2006 | Jaffe et al. |

(Continued)

FOREIGN PATENT DOCUMENTS

| | | | |
|---|---|---|---|
| CA | 2119848 | A1 | 9/1994 |
| WO | 9950540 | A1 | 10/1999 |

*Primary Examiner* — Thomas Moulis

(74) *Attorney, Agent, or Firm* — Julia Voutyras; John D. Russell; B. Anna McCoy

(57) ABSTRACT

An induction system in an engine is provided. The air induction system includes an induction conduit including an air flow passage in fluidic communication at least one combustion chamber in the engine and a passive-adsorption hydrocarbon trap positioned within the induction conduit, a portion of the passive-adsorption hydrocarbon trap defining a boundary of the air flow passage, the passive-adsorption hydrocarbon trap including a breathable layer coupled to a substrate layer coupled to the induction conduit, a hydrocarbon adsorption layer interposing the breathable layer and the substrate layer.

19 Claims, 14 Drawing Sheets

(56) References Cited

U.S. PATENT DOCUMENTS

| | | | | |
|---|---|---|---|---|
| 7,163,574 | B2 | 1/2007 | Bause et al. | |
| 7,168,417 | B2 | 1/2007 | Arruda et al. | |
| 7,225,799 | B2 | 6/2007 | Wang et al. | |
| 7,261,091 | B2 | 8/2007 | Reddy | |
| 7,276,098 | B2 | 10/2007 | Koslow | |
| 7,344,586 | B2 | 3/2008 | Zulauf et al. | |
| 7,377,966 | B2 | 5/2008 | Smith et al. | |
| 7,531,029 | B2 | 5/2009 | Hoke et al. | |
| 7,550,118 | B2 | 6/2009 | Merry | |
| 7,610,904 | B2 | 11/2009 | Treier et al. | |
| 7,645,426 | B2 | 1/2010 | Merry | |
| 7,691,188 | B2 | 4/2010 | Weber et al. | |
| 7,895,983 | B2 | 3/2011 | Braithwaite et al. | |
| 7,909,024 | B2 | 3/2011 | Rea et al. | |
| 7,918,912 | B2 | 4/2011 | Tomlin et al. | |
| 8,191,535 | B2 | 6/2012 | Bellis et al. | |
| 8,191,539 | B2 | 6/2012 | Bellis | |
| 8,413,433 | B2 | 4/2013 | Lupescu | |
| 8,439,013 | B2 | 5/2013 | Bellis | |
| 8,459,237 | B2 | 6/2013 | Erdmann et al. | |
| 8,828,325 | B2 | 9/2014 | DaCosta et al. | |
| 8,967,128 | B2 | 3/2015 | Bellis | |
| 9,174,163 | B2 | 11/2015 | Bellis et al. | |
| 2002/0029693 | A1* | 3/2002 | Sakakibara | B01D 46/0023 96/134 |
| 2002/0059920 | A1* | 5/2002 | Yoshioka | F02M 35/04 123/518 |
| 2003/0145732 | A1 | 8/2003 | Leffel et al. | |
| 2003/0192512 | A1 | 10/2003 | Luley et al. | |
| 2004/0050252 | A1* | 3/2004 | Wernholm | B01D 53/0415 95/143 |
| 2004/0099253 | A1 | 5/2004 | Tschantz | |
| 2005/0145224 | A1* | 7/2005 | Zulauf | B01D 53/02 123/518 |
| 2006/0054142 | A1 | 3/2006 | Burke et al. | |
| 2006/0162704 | A1 | 7/2006 | Hagler et al. | |
| 2006/0185651 | A1 | 8/2006 | Hagler | |
| 2007/0107701 | A1 | 5/2007 | Buelow et al. | |
| 2007/0199547 | A1 | 8/2007 | Shears et al. | |
| 2008/0092857 | A1 | 4/2008 | Callahan et al. | |
| 2009/0282793 | A1* | 11/2009 | Tomlin | F02M 25/0854 55/385.3 |
| 2009/0301071 | A1 | 12/2009 | Dobert et al. | |
| 2010/0065030 | A1* | 3/2010 | Bellis | B01D 53/0415 123/574 |
| 2010/0089368 | A1* | 4/2010 | Hirata | B01D 53/0431 123/518 |
| 2010/0089372 | A1* | 4/2010 | Bellis | F02M 25/0854 123/573 |
| 2011/0011670 | A1* | 1/2011 | Ishida | F01N 1/04 181/247 |
| 2014/0165542 | A1* | 6/2014 | Loftin | F02M 33/04 60/311 |
| 2015/0219046 | A1* | 8/2015 | Weckerle | F02M 25/0854 96/147 |

* cited by examiner

INDUCTION SYSTEM INCLUDING A PASSIVE-ADSORPTION HYDROCARBON TRAP

CROSS REFERENCE TO RELATED APPLICATION

The present application is a continuation-in-part of U.S. patent application Ser. No. 13/456,615, entitled "INDUCTION SYSTEM INCLUDING A PASSIVE-ADSORPTION HYDROCARBON TRAP," filed on Apr. 26, 2012, which claims priority to U.S. Provisional Patent Application No. 61/606,267, filed on Mar. 2, 2012, entitled "INDUCTION SYSTEM INCLUDING A PASSIVE-ADSORPTION HYDROCARBON TRAP," the entire contents of each of which are hereby incorporated by reference for all purposes.

BACKGROUND/SUMMARY

Evaporative emissions may be caused by fuel vapor escaping from various systems, components, etc., in an engine or other portions of a vehicle. For example, fuel sprayed into an intake manifold, by a fuel injector, may remain on the walls in intake manifold after the engine is shut down and not performing combustion. Consequently, fuel vapor may flow out of the intake system during engine shut down. As a result, evaporative emissions may be increased and in some cases exceed government mandated requirements. Evaporative emissions also have an environmental impact. For example, the emission may create a haze when exposed to sunlight.

Therefore, systems have been developed to capture fuel vapor in intake conduits to reduce evaporative emissions. For example, US 2006/0054142 discloses an intake system with a hydrocarbon trap positioned at a low point in the intake system to capture fuel vapor. Fuel vapors may be absorbed and released from the hydrocarbon trap to reduce evaporative emissions.

However, the Inventors have recognized several drawbacks with the intake system disclosed in US 2006/0054142. For example, the hydrocarbon trap is integrated into a housing of a conduit in the intake system thereby increasing the manufacturing cost of the intake system, as well as reducing the adaptability of the hydrocarbon trap. Moreover, the activated carbon is directly coupled to the housing. The direct attachment of the activated carbon to the housing may inhibit the trap from being easily removed, repaired, and/or replaced, and may increase manufacturing costs. Furthermore, the activated carbon may not properly adhere to the housing. As a result, the activated carbon may be released into the intake system and flow downstream into the engine, degrading engine operation. Additionally, fuel stored in the activated carbon may degrade the housing. Moreover, the hydrocarbon trap is positioned at a low point in the intake system, thereby constraining the position of the hydrocarbon trap.

As such, in one approach an induction system in an engine is provided. The air induction system includes an induction conduit including an air flow passage in fluidic communication with at least one combustion chamber in the engine and a passive-adsorption hydrocarbon trap positioned within the induction conduit, a portion of the passive-adsorption hydrocarbon trap defining a boundary of the air flow passage, the passive-adsorption hydrocarbon trap including a breathable layer coupled to a substrate layer coupled to the induction conduit, a hydrocarbon adsorption layer interposing the breathable layer and the substrate layer.

In this way, the substrate layer may be securely attached to the intake conduit, reducing the likelihood of degradation of the intake conduit via fuel in the adsorption layer and/or degradation of the engine via release of the hydrocarbons. Additionally, when the substrate layer is coupled to the breathable layer to enclose the hydrocarbon adsorption layer, the passive-adsorption hydrocarbon trap may be separately constructed from the induction conduit. As a result, the passive-adsorption hydrocarbon trap may be placed in a greater number of locations when compared to an adsorption layer integrated into an induction conduit. Moreover, the manufacturing costs may be reduced when the hydrocarbon trap is separately constructed from the induction conduit.

In some examples, the breathable layer and an inner wall of the housing of the induction conduit may be contiguous with one another and positioned to form a continuous, uninterrupted linear surface (e.g., without sharp edges, ledges, shelves, or other discontinuities) defining the boundary of the air flow passage, thereby reducing losses in the air flow passage. Further in some examples, the diameter or cross-sectional area of the air flow passage may remain constant transitioning into a section of the induction conduit having the passive-adsorption hydrocarbon trap coupled thereto. As a result, losses in the air flow passages are further reduced, thereby maintaining the efficiency of the induction system.

In another example, an example system comprises an air box having an air filter, the air box having a hydrocarbon trap and a removable lid, and internal reinforcing structures creating one or more pockets; and a hydrocarbon trap material positioned within one or more of the pockets, the lid defining a boundary of the air flow passage, the air box including a layer coupled over the pockets In another example, structural reinforcing elements may be on another wall of the air box, thereby forming the pockets, rather than or in addition to on the lid. In this way, structural reinforcing members that are used to reduce NVH may be re-purposed to form a low cost and effective hydrocarbon trap.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

FIGS. 14-20B are drawn approximately to scale.

FIGS. 24 to 34 are drawn approximately to scale.

DETAILED DESCRIPTION

A passive-adsorption hydrocarbon trap coupled to an induction conduit is described herein. The passive-adsorption hydrocarbon trap includes a hydrocarbon adsorption layer interposing a breathable layer and a substrate layer. The breathable layer may be coupled to the substrate layer around a lateral and longitudinal periphery of each of the layers to enclose the hydrocarbon adsorption layer. In this way, the passive-adsorption hydrocarbon trap may be separately manufactured from the induction conduit as opposed to coating or dipping the induction conduit in an adsorption material. As a result, the passive-adsorption hydrocarbon trap may be shaped and sized in a desired manner to conform to fit a variety of locations in an induction system. Moreover, the manufacturing cost of the passive-adsorption hydrocarbon trap may be reduced when it is separately constructed from the induction conduit.

Figure 1:
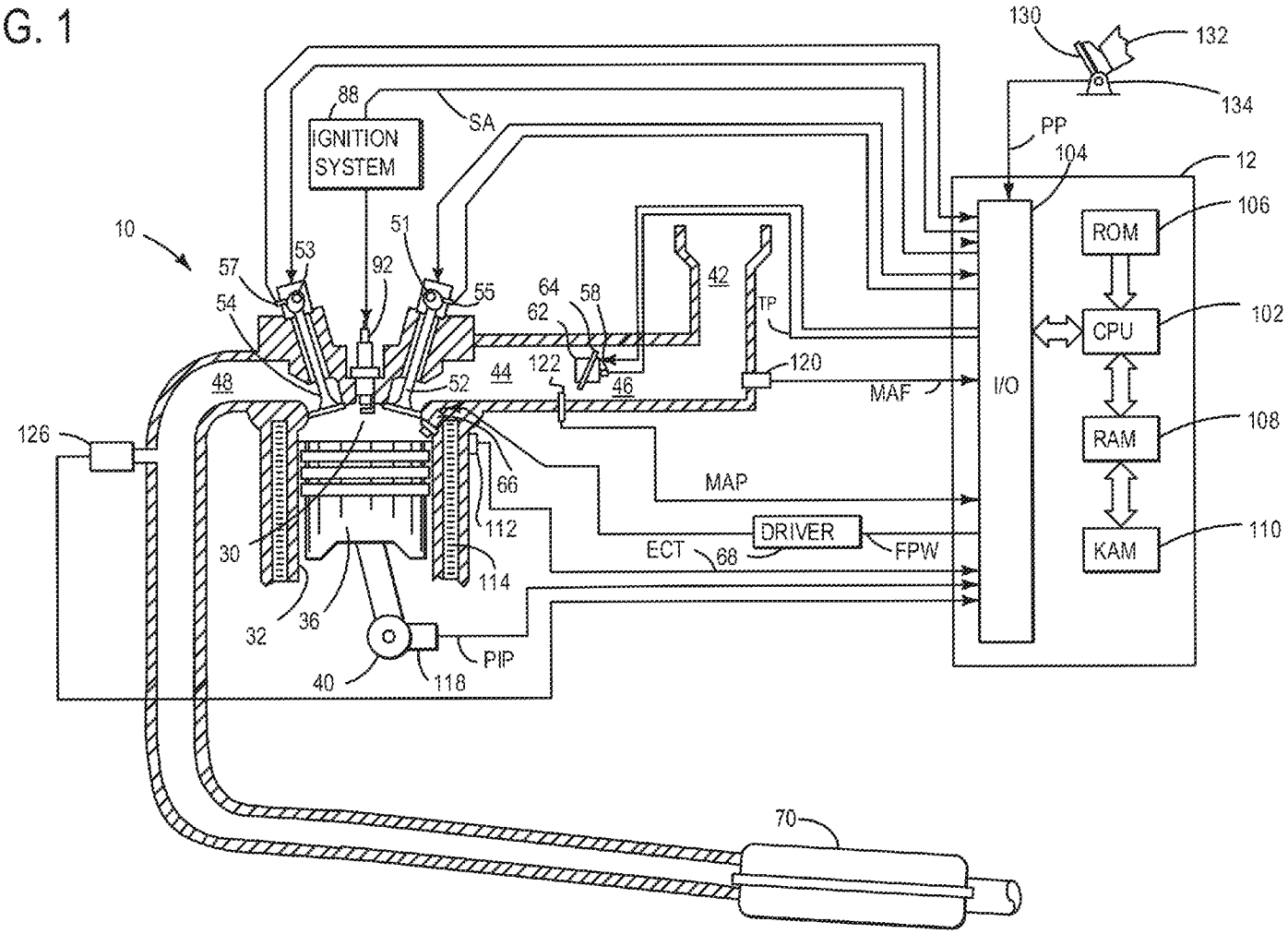
FIG. 1 shows a schematic depiction of an engine.
Figure 2:
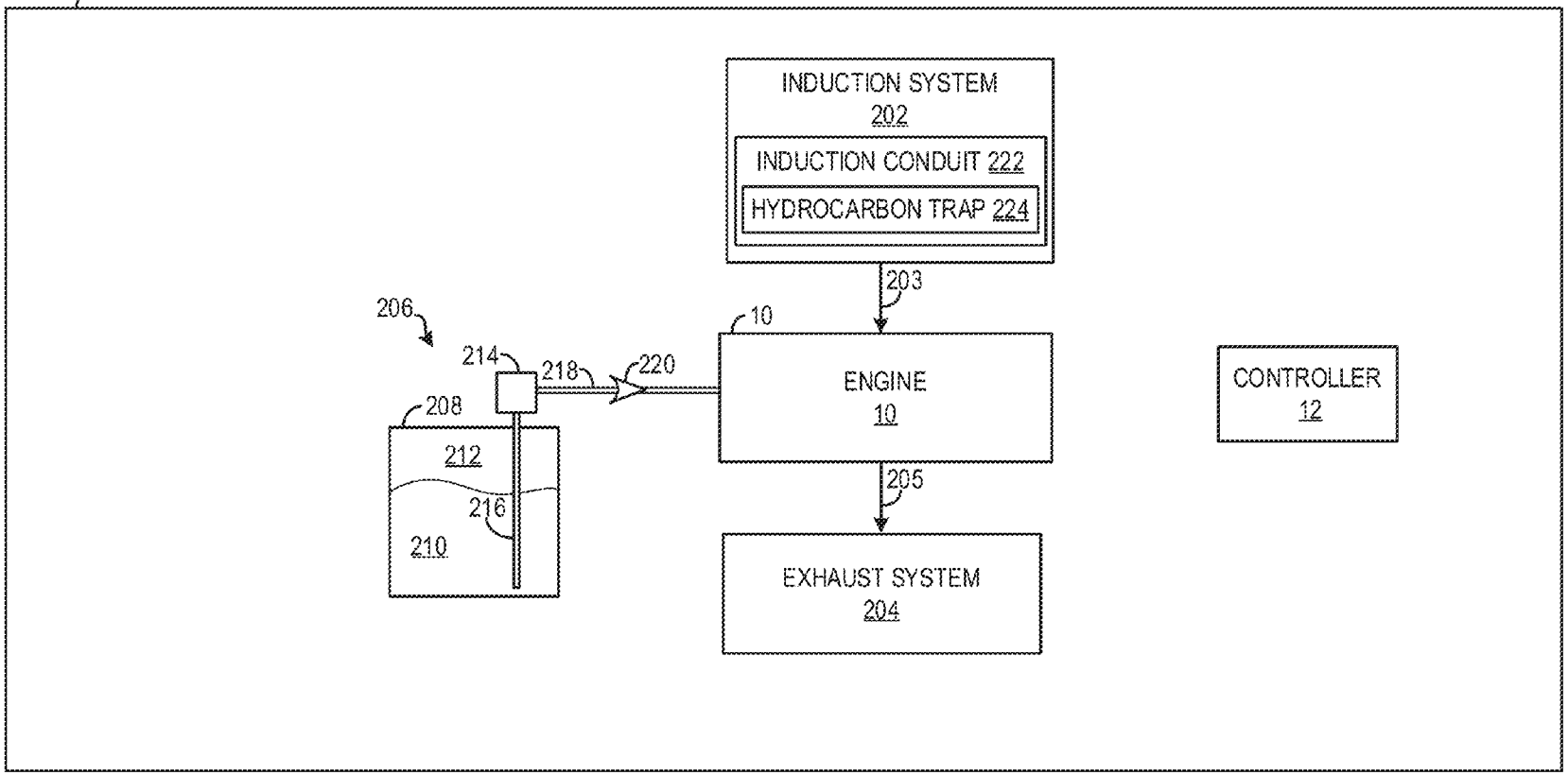
FIG. 2 shows a schematic depiction of a vehicle including a fuel delivery system, an induction system having a passive-adsorption hydrocarbon trap, an exhaust system, and the engine shown in FIG. 1.
Figure 3:
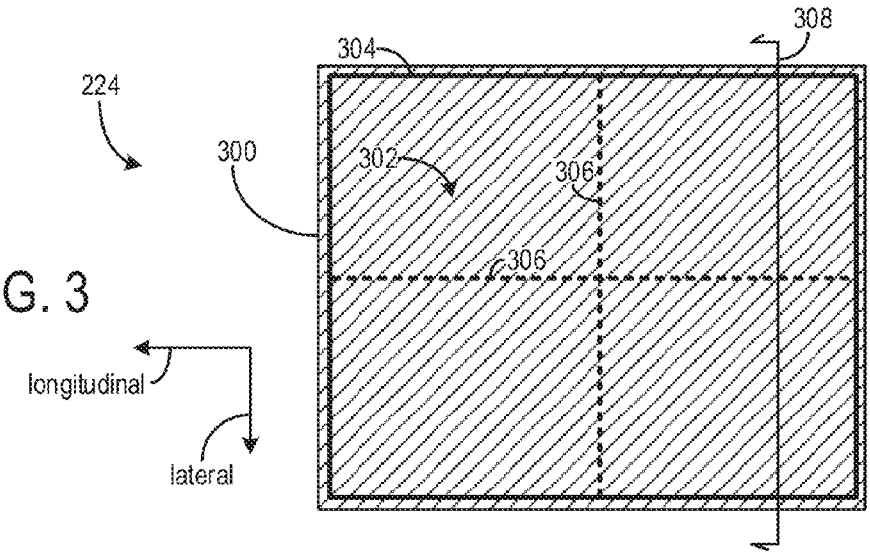
FIGS. 3-5 show a first embodiment of the passive-adsorption hydrocarbon trap shown in FIG. 2.
Figure 4:
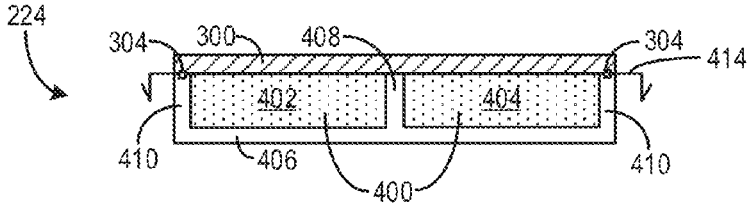
Figure 5:
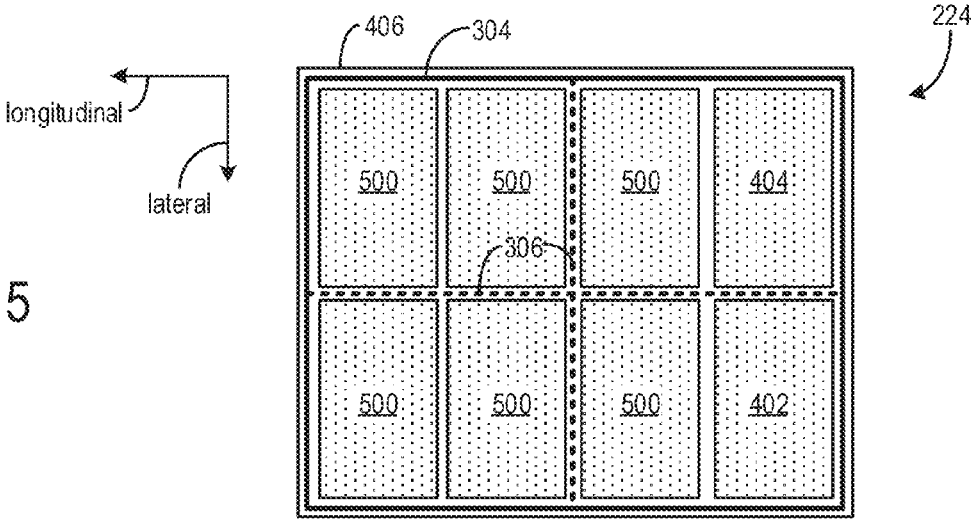
Figure 10:
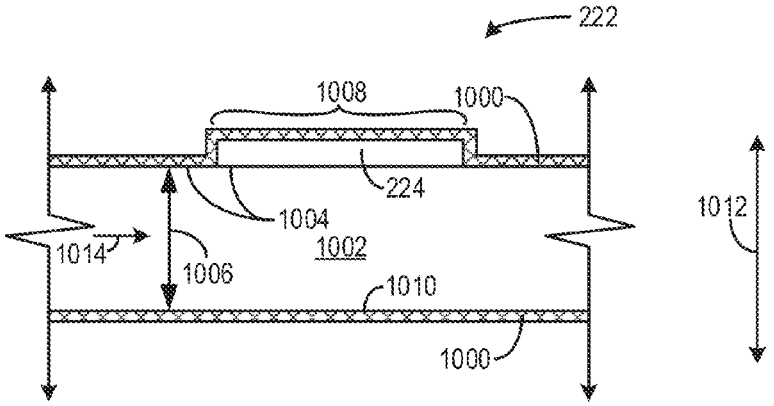
FIG. 10 shows an example induction conduit enclosing the passive-adsorption hydrocarbon trap shown in FIG. 2.
Figure 11:
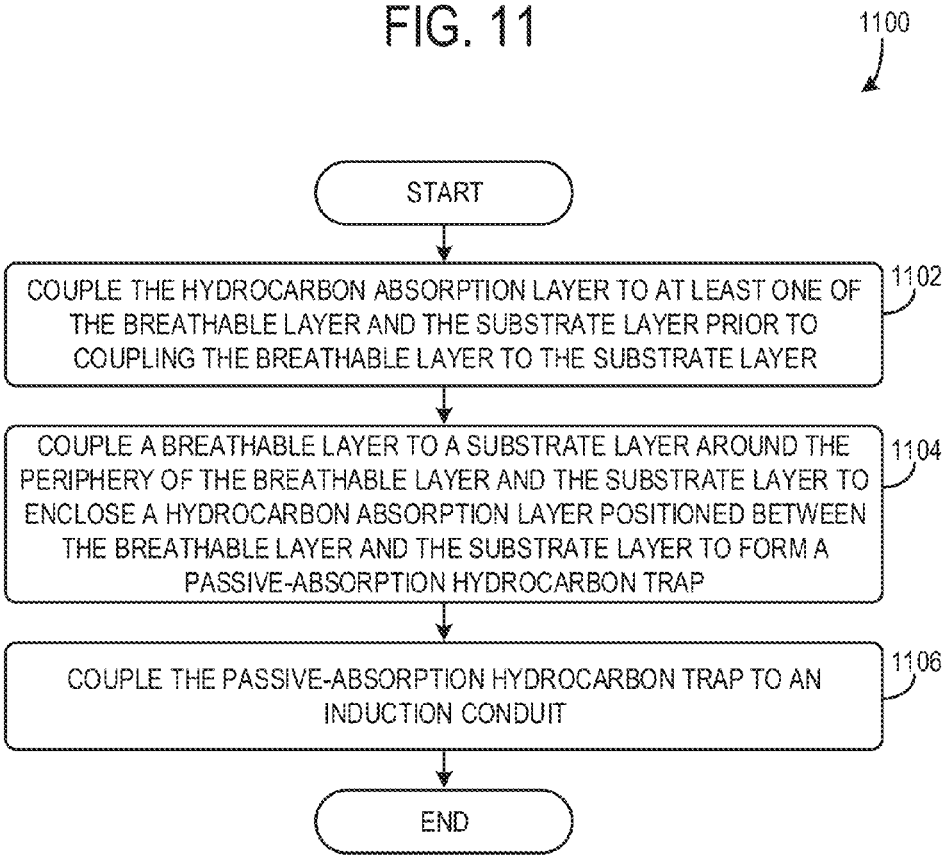
FIG. 11 shows a method for constructing a passive-adsorption hydrocarbon trap.
Figure 12:
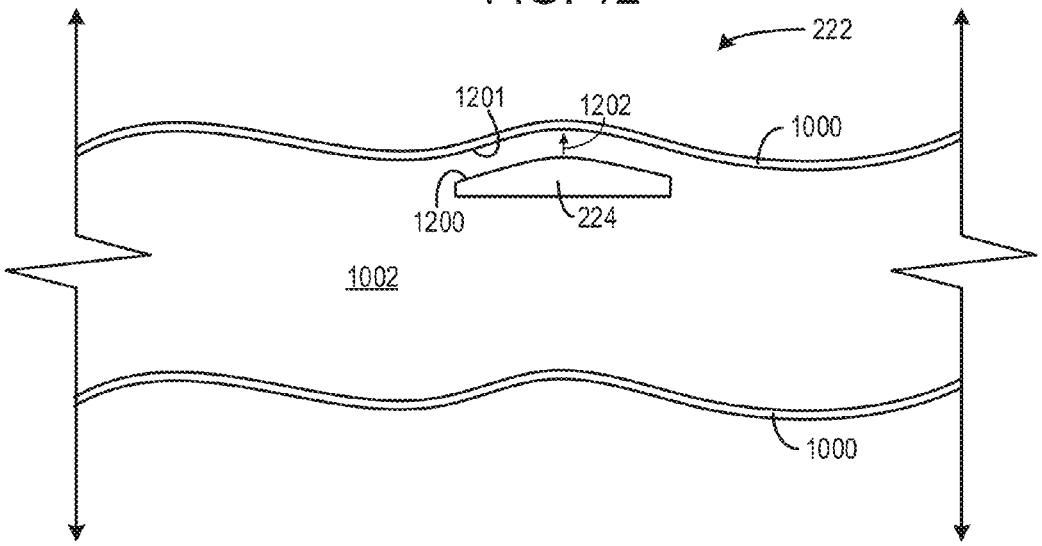
FIG. 12 shows another example induction conduit enclosing the passive-adsorption hydrocarbon trap shown in FIG. 2.
Figure 13:
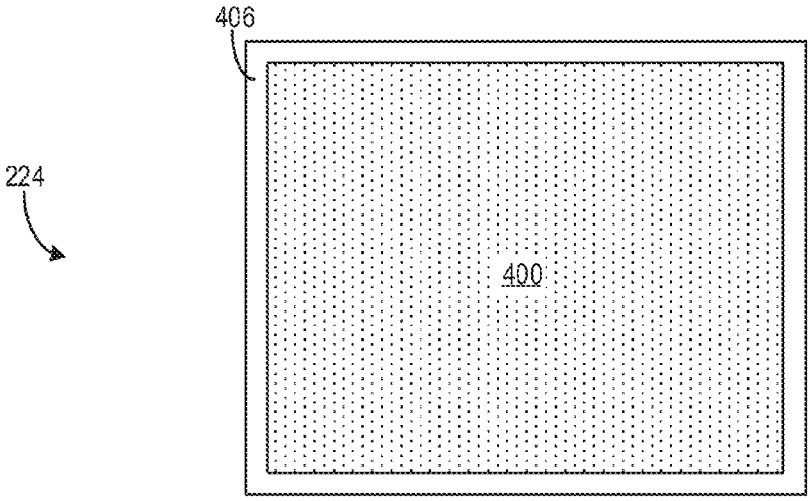
FIG. 13 shows another embodiment of the passive adsorption hydrocarbon trap shown in FIG. 2.
Figure 20A:
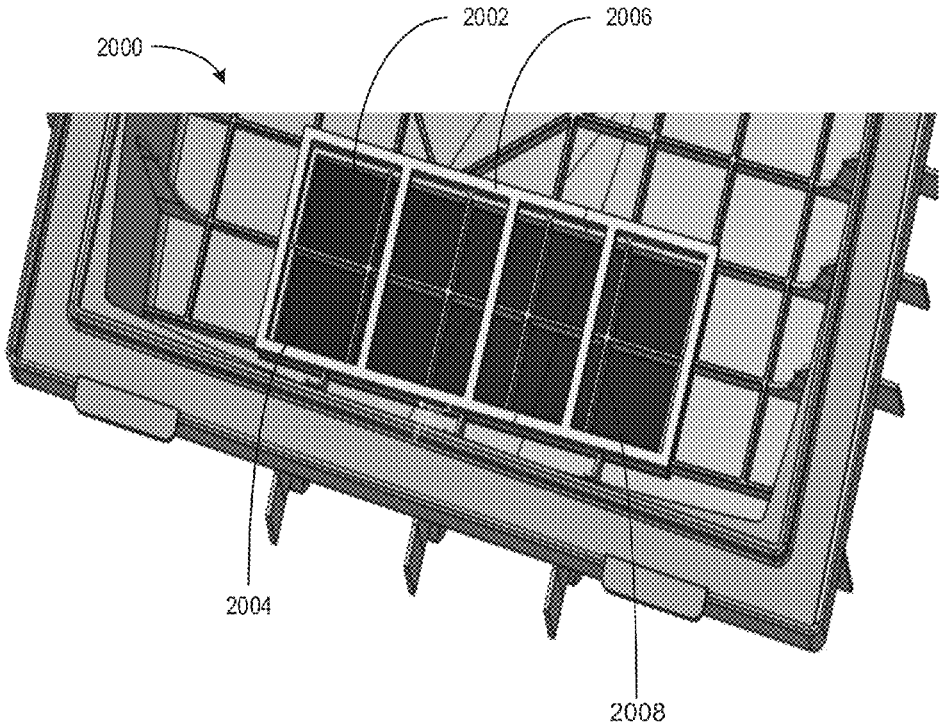
FIGS. 20A and 20B show an example of a bypass hydrocarbon trap.
Figure 20B:
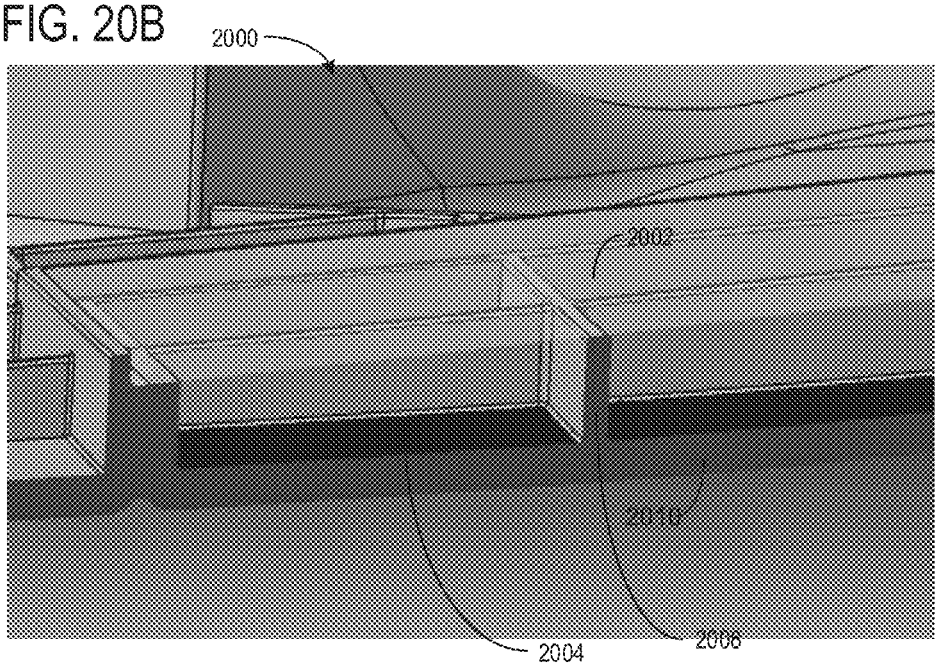
Figure 21:
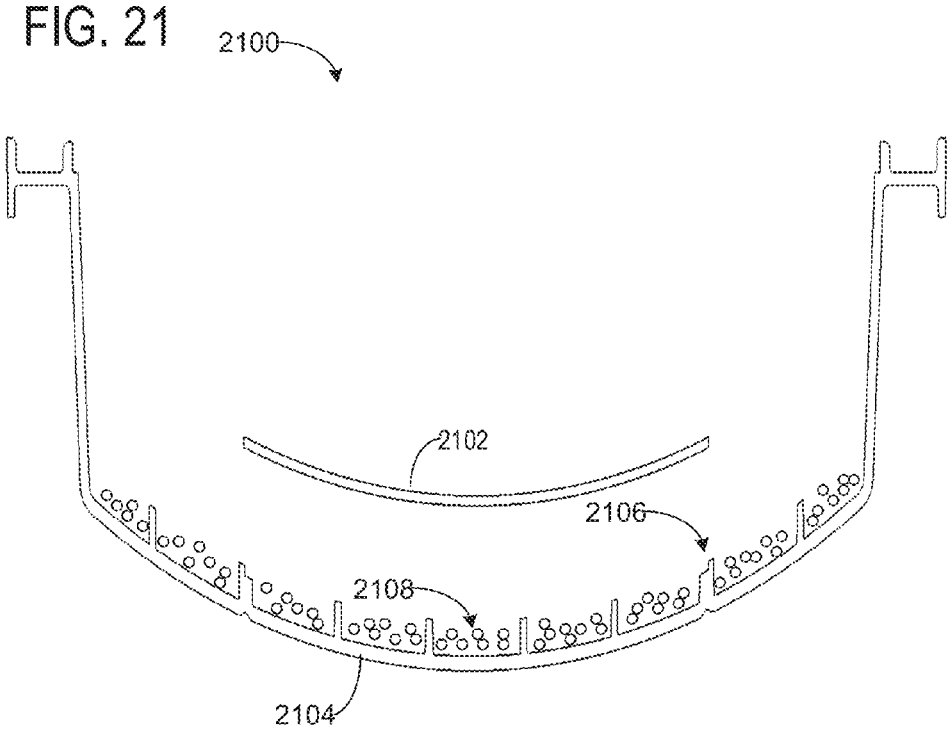
FIG. 21 shows an embodiment of the bypass hydrocarbon trap.

FIG. 1 shows a schematic depiction of an engine. FIG. 2 shows a schematic depiction of a vehicle including the engine shown in FIG. 1 and an induction system including a passive-adsorption hydrocarbon trap. FIGS. 3-5 show a first embodiment of the passive-adsorption hydrocarbon trap shown in FIG. 2. FIGS. 6-9 show alternate embodiments of the passive-adsorption hydrocarbon trap shown in FIG. 2. FIG. 10 shows an example induction conduit enclosing the passive-adsorption hydrocarbon trap. FIG. 11 shows a method for construction of a passive-adsorption hydrocarbon trap. FIG. 12 shows another example induction conduit enclosing the passive-adsorption hydrocarbon trap shown in FIG. 2 and FIG. 13 shows another embodiment of the passive adsorption hydrocarbon trap shown in FIG. 2. FIGS. 20A and 20B show an alternative embodiment of the hydrocarbon trap. Specifically, they show a bypass hydrocarbon trap. FIG. 21 shows an embodiment of the bypass hydrocarbon trap.

FIGS. 1-20B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to a crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively or additionally, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Additionally or alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 which responds to controller 12. In addition, intake manifold 44 is shown communicating with optional electronic throttle 62 which adjusts a position of throttle plate 64 to control air flow from intake boost chamber 46. In other examples, the engine 10 may include a turbocharger having a compressor positioned in the induction system and a turbine positioned in the exhaust system. The turbine may be coupled to the compressor via a shaft. A high pressure, dual stage, fuel system may be used to generate higher fuel pressures at injectors 66.

Distributorless ignition system 88 provides an ignition spark to combustion chamber 30 via spark plug 92 in response to controller 12. However, in other examples the ignition system 88 may not be included in the engine 10 and compression ignition may be utilized. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by foot 132; a knock sensor for determining ignition of end gases (not shown); a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g., when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. Additionally or alternatively compression may be used to ignite the air/fuel mixture. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples.

FIG. 2 shows a vehicle 200 including the engine 10. The vehicle 200 further includes an induction system 202 configured to supply air to combustion chambers in the engine 10. Thus, the induction system 202 may draw air from the surrounding environment and provide the air to the engine 10. Arrow 203 denotes the flow of intake air from the induction system 202 to the engine 10. The induction system 202 may include various components, such as the throttle 62, intake manifold 44, and intake passage 42 shown in FIG. 1.

The vehicle 200 further includes an exhaust system 204 configured to receive exhaust gas from the engine 10. The exhaust system 204 may include the exhaust manifold 48 and the emission control device 70 shown in FIG. 1. It will be appreciated that the exhaust system 204 may receive exhaust gas from the engine 10 and expel the exhaust gas into the surrounding environment. Arrow 205 denotes the flow of exhaust gas from the engine 10 into the exhaust system 204.

The vehicle 200 further includes a fuel delivery system 206 including a fuel tank 208 housing a fuel 210 such as gasoline, diesel, bio-diesel, alcohol (e.g., ethanol, methanol), or a combination thereof. Fuel vapor 212 may also be enclosed in the fuel tank 208.

The fuel delivery system 206 further includes a fuel pump 214 having a pick-up tube 216 extending into the fuel tank 208. In the depicted example the fuel pump 214 is positioned external to the fuel tank 208. However, in other examples the fuel pump 214 may be positioned in the fuel tank 208.

A fuel conduit 218, included in the fuel delivery system 206, enables fluidic communication between the fuel pump 214 and the engine 10. Arrow 220 indicates the flow of fuel into the engine 10. The fuel delivery system 206 may also include valves for regulating the amount of fuel provided to the engine 10. It will be appreciated that the fuel delivery system 206 may include additional components that are not depicted such as injectors (e.g., direct injectors, port injectors), a higher pressure fuel pump, a fuel rail, etc.

The induction system 202 includes at least one induction conduit 222. The induction conduit 222 may include a passive-adsorption hydrocarbon trap 224. The passive-adsorption hydrocarbon trap 224 may be positioned upstream of the throttle 62 shown in FIG. 1, in some examples. However, other positions for the passive-adsorption hydrocarbon trap have been contemplated. For example, the passive-absorption hydrocarbon trap 224 may be positioned within the intake manifold 44, shown in FIG. 1. Continuing with FIG. 2, the passive-adsorption hydrocarbon trap 224 is configured to absorb fuel vapor. In this way, the passive-adsorption hydrocarbon trap 224 may reduce the amount of emissions escaping from the induction system 202 when the engine 10 is not performing combustion. The passive-adsorption hydrocarbon trap 224 is discussed in greater detail herein.

The induction conduit 222 is in fluidic communication with the combustion chamber 30 shown in FIG. 1. The induction system 202 may also include the intake manifold 44 shown in FIG. 1, the throttle 62 shown in FIG. 1, and the intake valve 52 shown in FIG. 1. The induction conduit 222 may be positioned upstream of the throttle 62, in some examples.

It will be appreciated that the fuel pump 214 may be controlled via controller 12. However, in other examples, the fuel pump 214 may be controlled via an internal controller.

FIGS. 3-5 show various views of a first embodiment of the passive-adsorption hydrocarbon trap 224 shown in FIG. 2. FIG. 3 shows a top view of the passive-adsorption hydrocarbon trap 224. A breathable layer 300 is shown. Specifically, a first side 302 of the breathable layer 300 is depicted. The passive-adsorption hydrocarbon trap 224 may include additional layers positioned underneath the breathable layer 300. In particular, the passive-adsorption hydrocarbon trap 224 may include a substrate layer 406, depicted as a tray, shown in FIG. 4, discussed in greater detail herein. The breathable layer 300 may be coupled to the substrate layer along a lateral and longitudinal periphery of the breathable layer and the substrate layer. Line 304 denotes the location of a coupling interface between the breathable layer 300 and the substrate layer. It will be appreciated that the interface may be on a second side of the breathable layer 300. Additionally, in some examples, additional coupling interfaces, denoted via lines 306, may couple the breathable layer 300 to the substrate layer. The coupling interfaces 306 may extend between sections a hydrocarbon adsorption layer 400, shown in FIG. 5 discussed in greater detail herein. Cutting plane 308 defines the cross-section shown in FIG. 4. The coupling interface may be an adhesive bonding interface, a stitched interface, and/or a welding interface. Specifically, the coupling interface may be a spray adhesive, sew stitching, thermobonding, heat staking, and/or welding (e.g., ultrasonic welding, hot plate welding, infrared (IR) welding). The adhesive bonding interface may include an adhesive coupling the breathable layer to the substrate layer. The stitched interface may include stitches made with a thread. The welding interface may include a weld generated via heat and/or pressure. It will be appreciated that in some embodiments a portion of the coupling interface 306 may be formed via one type of attachment technique, while another portion of the interface may be formed via another attachment technique.

FIG. 4 shows a cross-sectional view of the passive-adsorption hydrocarbon trap 224 shown in FIG. 3. Specifically, a hydrocarbon adsorption layer 400 is shown positioned below the breathable layer 300. In other examples, a plurality of hydrocarbon adsorption layers may be included in the passive-adsorption hydrocarbon trap 224.

The breathable layer 300 provides air flow exchange to allow adsorption/desorption of hydrocarbons into the hydrocarbon adsorption layer 400. The breathable layer 300 also partially encloses the hydrocarbon adsorption layer 400 to reduce the likelihood of contamination of the induction system 202, shown in FIG. 1. The breathable layer 300 also provides constraint to the hydrocarbon adsorption layer 400 to reduce the likelihood of attraction between the layers.

The hydrocarbon adsorption layer 400 includes a first section 402 spaced away from a second section 404. Thus, the first section 402 is not in contact with the second section 404. The hydrocarbon adsorption layer 400 includes additional sections that are not depicted in FIG. 4. The passive-adsorption hydrocarbon trap 224 further includes a substrate layer 406, depicted as a tray. In some examples, the tray may be substantially rigid. That is to say that it may have a substantially greater rigidity than an elastomeric material. The tray may be slidably removable in one example and may slide laterally and/or longitudinally into a corresponding recessed pocket. The substrate layer 406 is configured to receive the hydrocarbon adsorption layer 400. Thus, the substrate layer 406 partially encloses the hydrocarbon adsorption layer 400. The hydrocarbon adsorption layer 400 also interposes the substrate layer 406 and the breathable layer 300. The substrate layer 406 may be coupled to the breathable layer 300. In this way, the breathable layer 300 and the substrate layer 406 enclose the hydrocarbon adsorption layer 400. As shown, the substrate layer 406 is in contact with the hydrocarbon adsorption layer 400 and includes a segment 408 extending between the first section 402 and the second section 404.

However, in other examples, the substrate layer 406 may not include the segment 408 and the sides 410 may be spaced away from the hydrocarbon adsorption layer 400. Sectioning the hydrocarbon adsorption layer 400 in this way increases the surface area of the hydrocarbon adsorption layer, thereby improving adsorption and desorption characteristics of the hydrocarbon adsorption layer. Additionally, segmenting the hydrocarbon adsorption layer 400 in this way provides air gaps in between sections of the hydrocarbon adsorption layer 400 reducing hydrocarbon migration throughout the hydrocarbon trap 224. In such an example, the substrate layer 406 may be coupled to the breathable layer 300 to enclose the hydrocarbon adsorption layer 400. Specifically, the substrate layer and the breathable layer may be coupled along a lateral and longitudinal periphery of each-other. A lateral axis and a longitudinal axis are shown in FIG. 5. The coupling interface 304 between the breathable layer 300 and the substrate layer 406 is also shown.

The breathable layer 300 may comprise a foam (e.g., open cell foam), a breathable fabric (e.g., non-woven polyester), and/or a thermo-carbonized non-woven film, in some examples. The substrate layer 406 may comprise a polymeric material, resin such as polyethylene, in some examples. Furthermore, the hydrocarbon adsorption layer 400 may comprise activated carbon, in some examples.

The breathable layer 300 may be coupled to the substrate layer 406 via an adhesive (e.g., spray adhesive), sew stitching, thermobonding, heat staking, and/or welding (e.g., ultrasonic welding, hot plate welding, and infrared (IR) welding). Additionally, the hydrocarbon adsorption layer 400 may be coupled to the breathable layer and/or the substrate layer 406 via an adhesive (e.g., spray adhesive), sew stitching, thermobonding, heat staking, and/or welding (e.g., ultrasonic welding, hot plate welding, IR welding). Adhesively coupling the hydrocarbon adsorption layer 400 to the substrate layer 406 and or breathable layer may reduce the relative motion of the hydrocarbon adsorption layer 400 decreasing attrition of a loose hydrocarbon adsorption layer. Furthermore, it will be appreciated that the passive-adsorption hydrocarbon trap 224 may be shaped and/or sized to accommodate different geometries of an intake passage without compromising the functionality of the hydrocarbon trap. Furthermore, when the aforementioned layers in the hydrocarbon trap 224 are coupled via adhesives, sew stitching, thermobonding, heat staking, and/or welding the hydrocarbon trap may be separately manufactured from the induction conduit 222, shown in FIG. 2, in which the trap is positioned. Consequently, the cost of manufacturing may be decreased due to the ability of the manufacturing process to be partitioned into separate steps. Cutting plane 414 shown in FIG. 4 defines the cross-section shown in FIG. 5.

FIG. 5 shows another cut-away view of the passive-adsorption hydrocarbon trap 224 shown in FIG. 3. As shown, the hydrocarbon adsorption layer 400 includes additional sections. Specifically, six additional sections 500 are shown. The sections 500 may have a similar size and/or geometry to the first and/or second sections (402 and 404). The sections 500 are positioned longitudinally behind the first and second section (402 and 404). A longitudinal axis and a lateral axis are provided for reference. The coupling interfaces (304 and 306) are also shown in FIG. 5. It will be appreciated that the coupling interfaces 306 segment sections of the hydrocarbon adsorption layer 400. In this way, the movement of the sections of the hydrocarbon adsorption layer 400 may be reduced.

Figure 6:
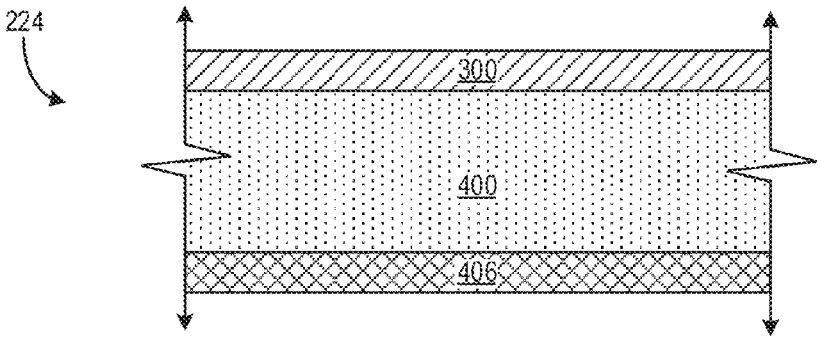
FIGS. 6-9 show alternate embodiments of the passive-adsorption hydrocarbon trap shown in FIG. 2.

FIG. 6 shows another embodiment of a cross-section of the passive-adsorption hydrocarbon trap 224 shown in FIG. 2. The passive-adsorption hydrocarbon trap 224, shown in FIG. 6, includes the breathable layer 300, the hydrocarbon adsorption layer 400, and the substrate layer 406. In such an example, the breathable layer 300 may be coupled to the substrate layer 406 via sew stitching, an adhesive (e.g., spay adhesive), welding (e.g., hot plate welding, ultrasonic welding, IR welding), heat staking and/or bonding (e.g., thermobonding). Specifically, the layers may be coupled around a lateral and longitudinal periphery to enclose the hydrocarbon adsorption layer 400. The substrate layer may be non-breathable and may comprise a polymeric material such as nylon, polypropylene, etc. Additionally, the breathable layer 300 may coupled to the substrate layer 406 and/or the breathable layer via an adhesive (e.g., spray adhesive), sew stitching, thermobonding, heat staking, and/or welding (e.g., ultrasonic welding, hot plate welding, IR welding).

Figure 7:
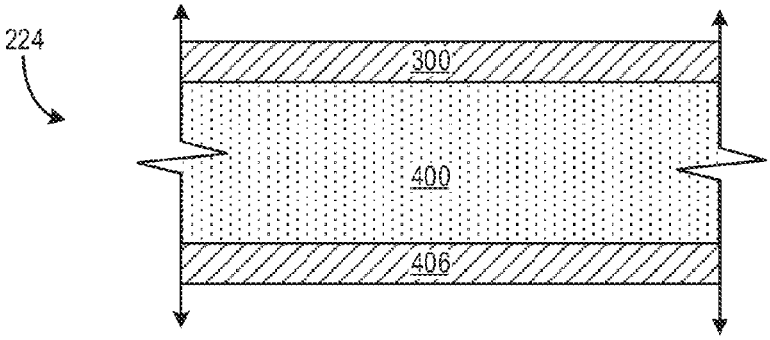

FIG. 7 shows another embodiment of a cross-section of the passive-adsorption hydrocarbon trap 224, shown in FIG. 2. As shown, the hydrocarbon adsorption layer 400 interposes the breathable layer 300 and the substrate layer 406. The substrate layer 406 shown in FIG. 7 may be constructed out of a similar material as the breathable layer 300, such as an open cell foam, a non-woven polyester, and/or another breathable fabric. The substrate layer 406 shown in FIG. 7 may be coupled to the first breathable layer 300 via an adhesive (e.g., spray adhesives), sew stitching, thermobonding, heat staking, and/or welding (e.g., ultrasonic welding, hot plate welding, IR welding).

Figure 8:
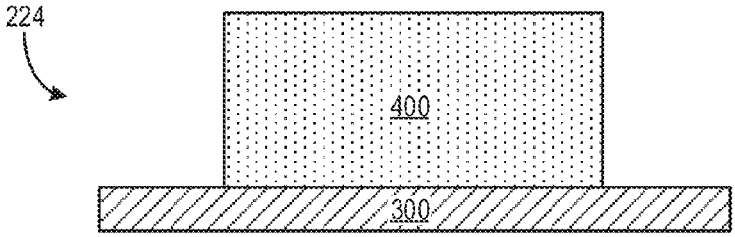

FIG. 8 shows another embodiment of a cross-section of the passive-adsorption hydrocarbon trap 224 shown in FIG. 2. As shown, the hydrocarbon trap includes the hydrocarbon adsorption layer 400 positioned above and coupled to the breathable layer 300. It will be appreciated that the breathable layer 300 may be coupled to a housing of the induction conduit 222, shown in FIG. 2. Therefore, in some examples, the housing of the induction conduit 222 and the breathable layer 300 may enclose the hydrocarbon adsorption layer 400. Still further in some examples, the breathable layer 300 may be the substrate layer 406 shown in FIG. 4, FIG. 6, or FIG. 7.

Figure 9:
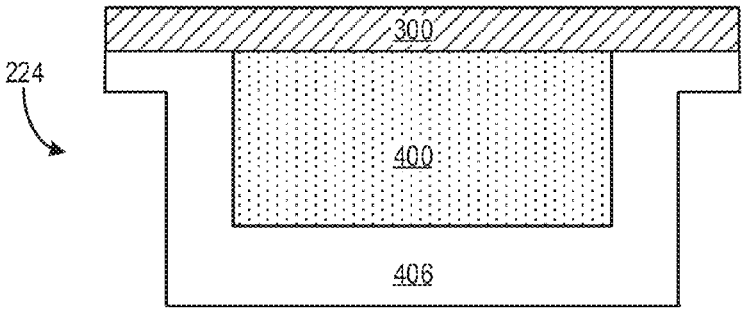

FIG. 9 shows another embodiment of a cross-section of the passive-adsorption hydrocarbon trap 224 shown in FIG. 2. The passive-adsorption hydrocarbon trap 224 includes the breathable layer 300 and the hydrocarbon adsorption layer 400. The breathable layer 300 may comprise thermo-carbonized non-woven film, in some examples. The passive-adsorption hydrocarbon trap 224 may also include the substrate layer 406 in the form of a tray. The tray may be coupled to the breathable layer 300. Additionally, the tray may comprise a non-breathable material in some examples.

FIG. 10, shows an example induction conduit 222 having a housing 1000. The housing 1000 encloses the passive-adsorption hydrocarbon trap 224. The induction conduit 222 also includes an air flow passage 1002. The boundary of the air flow passage 1002 is defined by the housing and an outer layer of the passive-adsorption hydrocarbon trap 224 (e.g., the breathable layer 300, shown in FIGS. 3, 6, 7, 8, and 9)

As shown, the passive-adsorption hydrocarbon trap 224 is coupled to the housing 1000. Specifically, the substrate layer 406 shown in FIGS. 3-9 may be coupled to the housing 1000. Furthermore, the passive-adsorption hydrocarbon trap 224 is shaped and sized to form a continuous surface 1004 with the housing 1000 of the induction conduit 222. In this way, losses within the induction system 202 may be reduced. However, other shapes and sizes of the passive-adsorption hydrocarbon trap 224 have been contemplated.

Additionally, the diameter or cross-sectional area 1006 of the air flow passage 1002 remains substantially constant as it transitions into a section 1008 of the induction conduit 222 having the passive-adsorption hydrocarbon trap 224 coupled thereto, in the depicted example. In this way, losses within the induction system may be reduced. However, alternate geometries have been contemplated. For example, the diameter or cross-sectional area of the air flow passage 1002 may decrease in the section 1008. In such an example, the diameter or cross-sectional area of the housing 1000 may remain substantially constant in the section of the induction conduit having the passive-adsorption hydrocarbon trap 224 coupled thereto.

Furthermore, the passive-adsorption hydrocarbon trap 224 is spaced away from a bottom 1010 of the air flow passage 1002. Specifically, the passive-adsorption hydrocarbon trap 224 is positioned adjacent to a top of the air flow passage 1002. A vertical axis 1012 is provided for reference with respect to the ground over which a vehicle travels, the vehicle including an engine coupled to an air induction system including conduit 222. However, other positions of the passive-adsorption hydrocarbon trap 224 have been contemplated. Arrow 1014 depicts the general direction of air flow during operation of the engine when combustion is being performed.

FIG. 10 also shows how an outer wall of the housing 1000 projects outward at section 1008 relative to the remaining outer wall of the housing. This contour matches the outward projection of the inner wall at section 108, thereby creating a recessed pocket into which the passive-adsorption hydrocarbon trap 224 is positioned and retained, where a depth of the projections corresponds to a height of the passive-adsorption hydrocarbon trap 224.

FIG. 11 shows a method 1100 for constructing a passive-adsorption hydrocarbon trap. The method 1100 may be used to construct the passive-adsorption hydrocarbon trap 224 discussed above with regard to FIGS. 2-10 or may be used to construct another suitable passive-adsorption hydrocarbon trap.

At 1102 the method includes coupling the hydrocarbon adsorption layer to at least one of the breathable layer and the substrate layer prior to coupling the breathable layer to the substrate layer. Specifically, in one example, the hydrocarbon adsorption layer may be coupled to the substrate layer. However, in other examples, the hydrocarbon adsorption layer may be coupled to the breathable layer. Next at 1104 the method includes coupling a breathable layer to a substrate layer around the periphery of the breathable layer and the substrate layer to enclose a hydrocarbon adsorption layer positioned between the breathable layer and the substrate layer to form a passive-adsorption hydrocarbon trap. At 1106 the method includes coupling the passive-adsorption hydrocarbon trap to an induction conduit. As previously discussed, the aforementioned layers (e.g., the breathable layer, the hydrocarbon adsorption layer, and the substrate layer) may be coupled via one or more of the following techniques; adhesive bonding (e.g., spray adhesive bonding), sew stitching, thermobonding, heat staking, and welding (e.g., ultrasonic welding, hot plate welding, IR welding).

FIG. 12 shows another example induction conduit 222 including housing 1000. The passive-adsorption hydrocarbon trap 224 and the air flow passage 1002, are also depicted. In this example, the housing 1000 has an uneven surface having multiple curves. It will be appreciated that the housing 1000 may have an alternate contour, in other examples. For example, the housing may be convex, concave, include compound angles, etc. As shown only one of the surface of the trap 224 may be curved to match, for example, surface 1200 of the passive-adsorption hydrocarbon trap 224 may have a similar contour to a surface 1201 of the housing 1000. The surface 1201 may be an exterior surface of the substrate layer 406 shown in FIGS. 4, 6, 7, and 9. The passive-adsorption hydrocarbon trap 224 is shown spaced away from the housing 1000 to illustrate the corresponding contoured surfaces. However, it will be appreciated that the passive-adsorption hydrocarbon trap 224 may be in face-sharing contact with the housing 1000 as denoted via arrow 1202 when employed in the induction system. In this way, the passive-adsorption hydrocarbon trap 224 may be shaped and sized in a desired manner to conform to fit a variety of locations in the induction system.

FIG. 13 shows another embodiment of the passive-adsorption hydrocarbon trap 224, shown in FIG. 2. As illustrated, the passive-adsorption hydrocarbon trap includes the substrate layer 406 and the hydrocarbon adsorption layer 400 having just a single section. In some examples, the breathable layer 300 may be coupled to the substrate layer 406 to enclose the hydrocarbon adsorption layer 400 shown in FIG. 3, as previously discussed. However, in other examples the breathable layer may not be included in the passive-adsorption hydrocarbon trap.

Figure 14:
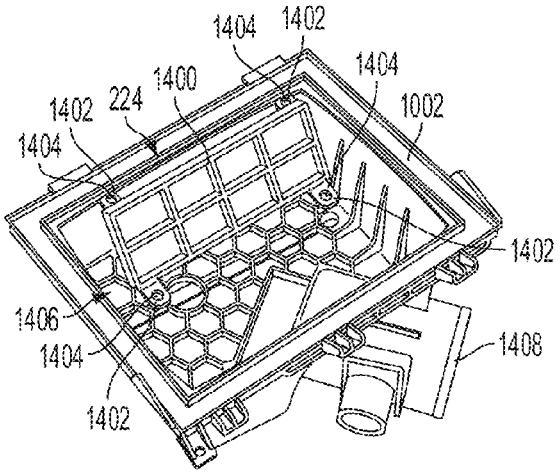
FIG. 14 shows an example induction conduit and a passive-adsorption hydrocarbon trap.

FIG. 14 shows another example induction conduit 1002 and passive-adsorption hydrocarbon trap 224. The passive-adsorption hydrocarbon trap 224 includes a tray 1400. It will be appreciated that the tray 1400 is an exemplary substrate layer. The tray 1400 includes attachment flanges 1402. Bolts 1404 or other suitable attachment apparatuses may be used to attach the tray to the induction conduit 1002. The induction conduit 1002 includes an inlet or 1406 and an outlet or inlet 1408. The induction conduit 1002 may be coupled to a portion the engine 10 or vehicle 200, shown in FIG. 2.

Figure 15:
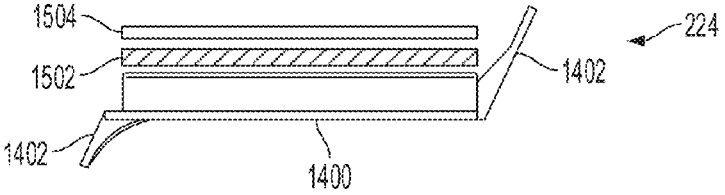
FIG. 15 shows the passive-adsorption hydrocarbon trap shown in FIG. 14.

FIG. 15 shows an exploded view of the passive-adsorption hydrocarbon trap 224 shown in FIG. 14. As illustrated, the passive-adsorption hydrocarbon trap 224 includes the tray 1400 which may comprise a polymeric material. It will be appreciated that the tray 1400 is an exemplary substrate layer.

The passive-adsorption hydrocarbon trap 224 also includes breathable foam layer 1502. The passive-adsorption hydrocarbon trap 224 may also include a breathable non-woven polyester layer 1504. The passive-adsorption hydrocarbon trap 224 may also include a hydrocarbon adsorption layer (not shown in FIG. 15) positioned between the tray 1400 and the foam layer 1502. It will be appreciated that the breathable foam layer 1502 and/or the breathable non-woven polyester layer 1504 may be coupled to the tray 1500. In this way, the carbon layer may be enclosed. The attachment flanges 1402 are also shown in FIG. 15.

Figure 16:
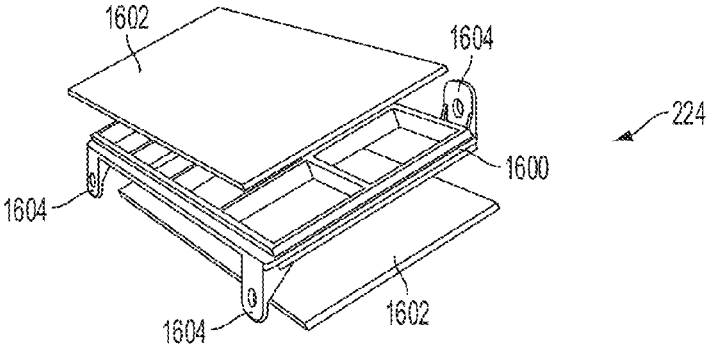
FIG. 16 shows an exploded another example passive-adsorption hydrocarbon trap.
Figure 17:
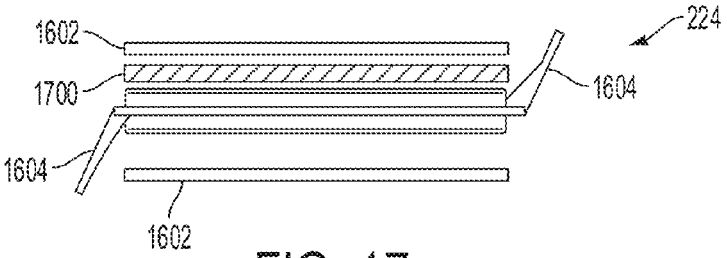
FIG. 17 shows another view of the passive-adsorption hydrocarbon trap shown in FIG. 16.

FIG. 16 shows an exploded view of another embodiment of the passive-adsorption hydrocarbon trap 224. The passive-adsorption hydrocarbon trap 224 includes a plastic cartridge 1600 partially enclosing a hydrocarbon absorption layer (not shown). The passive-adsorption hydrocarbon trap 224 further includes two breathable non-woven polyester layers 1602. Additionally, the passive-adsorption hydrocarbon trap 224 includes a breathable foam layer 1700, as shown in FIG. 17. Flanges 1604 are also shown in FIGS. 16 and 17. The passive-adsorption hydrocarbon trap 224 may also include a hydrocarbon adsorption layer (not shown in FIG. 15) positioned between one of the breathable non-woven polyester layer 1602 and the breathable foam layer 1700.

Figure 18:
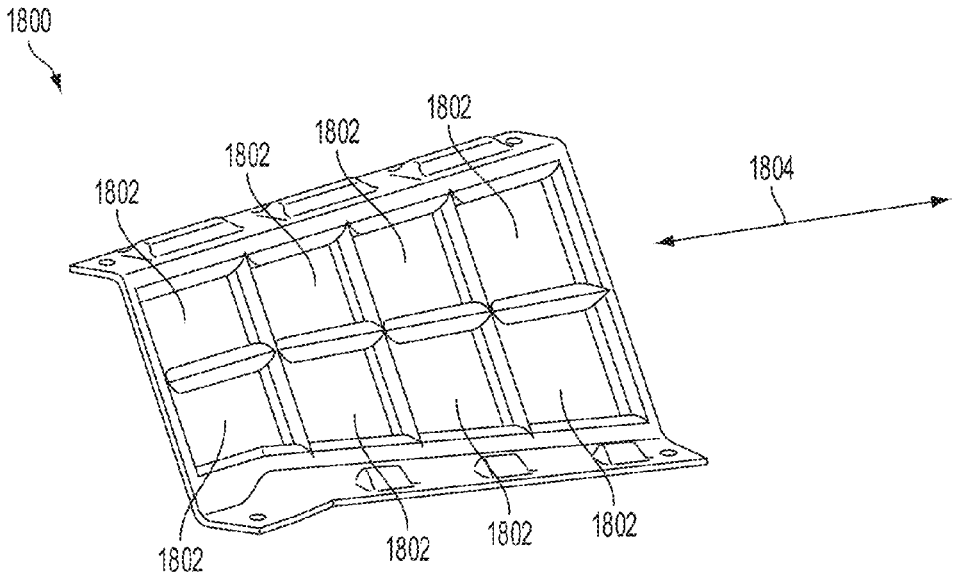
FIG. 18 shows an example tray.

FIG. 18 shows another embodiment of a tray 1800 included in the passive-adsorption hydrocarbon trap 224. The tray 1800 may be thermoformed and comprise non-woven polyester. The tray 1800 comprises thermoformed pockets 1802. The contours of the tray 1800 may be modified to conform to the contours of an induction conduit in which it is positioned. Specifically, the tray 1800 is tapered in a lateral direction. A lateral axis 1804 is provided for reference.

Figure 19:
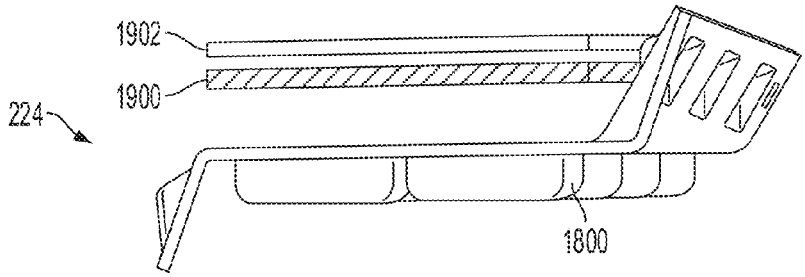
FIG. 19 shows an exploded view of an example passive-adsorption hydrocarbon trap including the tray shown in FIG. 18.

FIG. 19 shows an exploded view of the passive-adsorption hydrocarbon trap 224 including the tray 1800 shown in FIG. 18. As depicted the passive-adsorption hydrocarbon trap 224 includes a breathable foam layer 1900 and a breathable non-woven polyester layer 1902.

Turning now to FIG. 20A, a face-on view of a bypass hydrocarbon adsorption trap 2000 is shown. The bypass hydrocarbon adsorption trap 2000 may be located in a position similar to the location of the passive-adsorption hydrocarbon trap 224. The bypass hydrocarbon trap 2000 may also be located in a cavity of an intake passage, wherein a cover of the bypass hydrocarbon trap 2000 defines a surface of the intake passage. Gas may flow through the intake passage and flow over the cover of the bypass hydrocarbon trap or the gas may flow through the cover of the bypass hydrocarbon trap. The gas may flow into one or more pockets of the hydrocarbon trap 2000 in order to deposit fuel vapors and/or other hydrocarbon carrying materials.

The passive-adsorption hydrocarbon trap 224 described above is a hybrid hydrocarbon trap which comprises permeable membranes on both sides of a hydrocarbon adsorption material in order to allow gas (e.g., air) to flow through both membranes or twice through a single membrane in order to flow out of the hydrocarbon trap. The bypass hydrocarbon adsorption trap 2000 comprises a breathable layer 2002 coupled to a plurality of individual pockets 2004 on one side of the bypass hydrocarbon adsorption trap 2000, where each of the plurality of pockets comprises an amount of loosely packed hydrocarbon trapping material. In this way, fewer parts are used in order to manufacture the hydrocarbon trap, which may save money, decrease packaging constraints, and decrease a weight of the hydrocarbon trap. The breathable layer 2002 may be a non-woven polyester.

Bypass hydrocarbon adsorption trap 2000 further comprises ribs (e.g., walls) 2008 surrounding the pockets 2004. The walls 2008 may be impervious to gas flow such that gas may not flow through the walls 2008. In this way, gas in a single pocket of the pockets 2004 may not flow into an adjacent pocket of the pockets 2004. Additionally or alternatively, one or more of the walls 2008 (as depicted, each of the pockets 2004 has four walls 2008) of the pockets 2004 may be permeable to gas flow, but impervious to a flow of liquid and/or solids. In this way, a single pocket of the pockets 2004 may exchange gas with one or more adjacent pockets of the pockets 2004.

A removable cover 2006 may be coupled to the breathable layer 2002 such that the breathable layer is located between the removable cover 2006 and the walls 2008. In one embodiment, additionally or alternatively, the breathable layer 2002 and the removable cover 2006 may be a single piece such that the breathable layer 2002 is integrated into orifices of the removable cover 2006. The orifices of the removable cover correspond to locations of the pockets 2004.

A base may seal a bottom portion of the pockets 2004. As shown in FIG. 20B, base 2010 is physically coupled to walls 2008 and completely seals the bottom portion of the pockets 2004 such that no materials, regardless of their phase (e.g., gas, liquid, and solid) may flow through the base 2008. In this way, a space between the breathable layer 2002, the walls 2008, and the base 2010 defines a volume of a pocket of the pockets 2004. Furthermore, gas may enter the space and exit the space only by flowing through the breathable layer 2002.

As shown, the walls 2008 extend perpendicularly from the base 2010. The cover 2006 may be coupled to the walls 2008 via a substrate, screws, a weld, and/or a thermobonding. The substrate may be a breathable or non-breathable substrate.

Therefore, the bypass hydrocarbon adsorption trap 2000 comprises a plurality of pockets 2004 hermetically sealed from one another via walls 2008 and base 2010. Breathable layer 2002 is coupled to the walls 2008 of the pockets 2004 via one or more of a weld, adhesive, fastenings, etc. The breathable layer 2002 may be the only surface of the pockets 2004 which is able to allow entry for gases into the pockets 2004 while simultaneously providing an exit for gases in the pockets 2004. The breathable layer 2002, the walls 2008, and the base 2010 define a volume of the pockets 2004. Gas may flow over the bypass hydrocarbon trap 2000 without entering the pockets 2004 (e.g., bypassing the trap 2000). Additionally or alternatively, gas may flow into one or more pockets 2004 of the trap 2000 via flowing through the breathable layer 2002. Gas may flow into an individual pocket of the pockets 2004 via flowing in a first direction through the breathable layer 2002. Gas may then exit the individual pocket of the pockets 2004 via flowing in a second direction through the breathable layer 2002. The second direction and the first direction are opposite directions. Gas can not flow through the base 2010.

Furthermore, the pockets 2004 may be a shape equivalent to a shape of a rib structure of an air induction system. Therefore, they may be square, rectangular, triangular, hexagonal, honeycomb, or other suitable shapes matching a rib structure of the air induction system.

FIGS. 20A and 20B show an example embodiment of a bypass hydrocarbon trap located in a cavity of an intake passage. The cavity may located in a geodetically lower portion of the intake passage. For example, for a vehicle with four wheels on a flat surface, the cavity is closer to the flat surface than other portions of the intake passage along a shared axis. In this way, a likelihood of hydrocarbons flowing into the cavity is increased.

A surface of the cavity may include an internal reinforcing structure comprising of ribs and/or walls extending perpendicularly from the surface toward the intake passage. The ribs may be connected to one another with spaces located in between such that a container (e.g., pocket) may be formed. The cavity may comprise a plurality of containers. The containers may be a shape resembling a shape of corresponding connected ribs. For example, the container may be a square, rectangle, hexagon, circle, triangle, etc. Furthermore, a volume of the containers may be substantially similar. Additionally or alternatively, one or more of the containers may have different volumes wherein a first container may have a volume greater than a second container.

The containers may be filled with an amount of hydrocarbon trapping material. In an example, the hydrocarbon trapping material may be carbon, carbon pellets, charcoal, etc. The containers may be filled with exactly eight grams of hydrocarbon trapping material in one embodiment. In another embodiment, the containers may be filled with a corresponding amount of hydrocarbon trapping material based on a container volume (e.g., 60% of the container volume). The hydrocarbon trapping material may be packed within the containers without any substrates or binding additives. In this way, the hydrocarbon trapping material may be easily replaced upon becoming fully loaded with hydrocarbons. Furthermore, the hydrocarbon trapping material may decrease a vibration of walls of the intake passage such that audible noises are decreased.

A breathable layer may be coupled to a top of the internal reinforcing structure of the containers. The breathable layer may comprise a substrate layer only on locations of the breathable layer corresponding to locations of the internal reinforcing structure. For example, the substrate layer and the internal reinforcing structure align upon coupling the breathable layer to the internal reinforcing structure. Additionally or alternatively, the breathable layer may not comprise the substrate layer and may be coupled to the internal reinforcing structure via a removable lid. The breathable layer may allow gas (e.g., air, fuel vapors, etc.) to flow through its permeable membrane and into one or more containers of the bypass hydrocarbon trap located in the cavity of the intake passage.

The removable lid may comprise a plurality of orifices equal to a number of containers. A location of the orifices of the removable lid may correspond to a location of the containers such that the removable lid does not obstruct an opening of the containers. Furthermore, the removable lid may be similarly shaped to a shape of the internal reinforcing structure. The breathable layer may be located between the removable lid and the internal reinforcing structure when the removable lid is coupled to the reinforcing structure. In this way, the breathable layer is fixed to the reinforcing structure and may not be removed until the removable lid is removed. Furthermore, the hydrocarbon trapping material is secured within the containers by fixing the lid to the reinforcing structure.

In one example, the removable lid and the breathable layer may be an integrated, single piece such that removing the lid also removes the breathable layer. Furthermore, the integrated lid with a breathable layer may comprise a substrate layer capable of binding to the reinforcing structure.

Gas in the intake passage may flow through the breathable layer and enter one or more containers of the bypass hydrocarbon trap. Gas in the containers may deposit hydrocarbons onto the hydrocarbon trapping material before flowing through the breathable layer and into the intake passage. Gas may not flow through the surface of the cavity below the reinforcing structure or through the reinforcing structure. In this way, gas may only enter and leave the containers via the breathable layer. Alternatively, gas in the intake passage may flow over the breathable layer and does not enter any of the containers.

FIG. 21 shows a cross-section of a bypass hydrocarbon trap 2100 comprising a cover 2102, a base 2104, walls 2106, and hydrocarbon trapping material 2108. The cover 2102 and the base 2104 are similarly contoured with walls 2106 located in between the cover 2102 and the base 2104. The cover 2102 may rest on tops of the walls 2106 in order to prevent the hydrocarbon trapping material 2108 from falling out of a pocket of the bypass hydrocarbon trap 2100.

The hydrocarbon trapping material 2108 may be loosely packed into the pockets of the bypass hydrocarbon trap 2100. The pockets may comprise exactly 8 grams of hydrocarbon trapping material 2108. In one embodiment, the hydrocarbon trapping material may be carbon.

As gas flows into the bypass hydrocarbon trap 2100 and flows into the pockets, the gas may deposit fuel vapors or other hydrocarbon based species onto the hydrocarbon trapping material 2108 before flowing out of the bypass hydrocarbon trap 2100. As described above, gas may only flow into and out of the bypass hydrocarbon trap 2100 via the cover 2102. The cover 2102 may be permeable to only gases and atomized liquids and impervious to solids and liquids. In this way, the hydrocarbon trapping material 2108 may not exit the pockets of the bypass hydrocarbon trap 2100 when the cover 2102 is coupled to the walls 2104.

Figure 22:
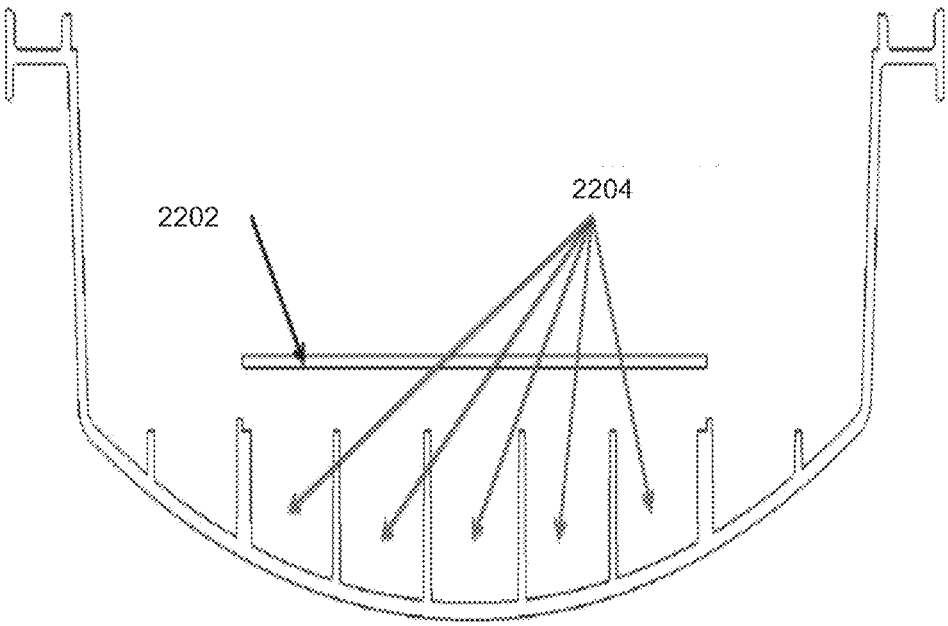
FIG. 22 shows an embodiment of a cover of the bypass hydrocarbon trap.

FIG. 22 shows a bypass hydrocarbon trap 2200 with a cover 2202 and pockets 2204. The pockets 2204 comprise tiered ribs (e.g., walls), where a height of the ribs increases as a contour of a base increases in order to allow the ribs to be at an equal height independent of the contour of the base. In this way, the cover 2202 is linear and sits over the ribs of the pockets 2204.

Figure 23:
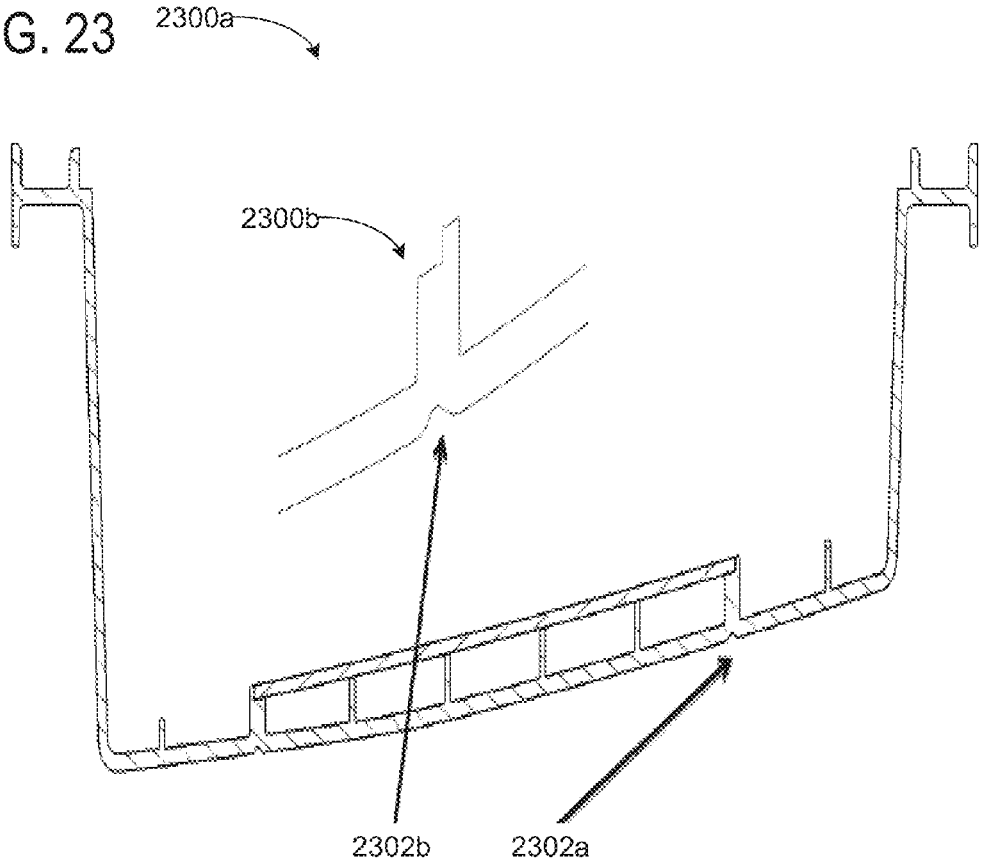
FIG. 23 shows an example of a sink mark channel.
Figure 24:
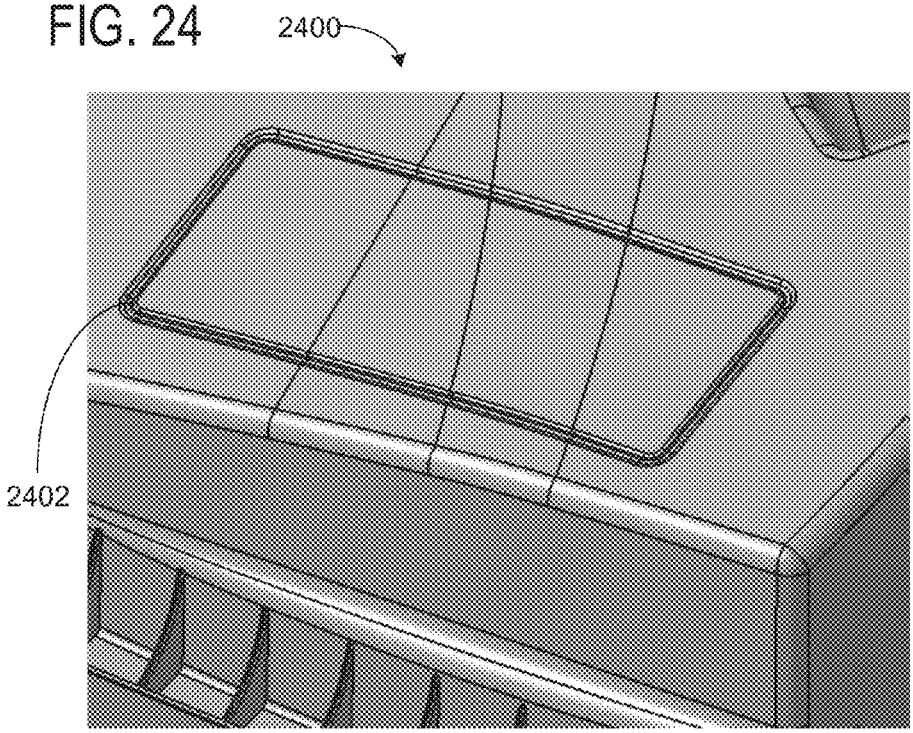
FIG. 24 shows a second example of the sink mark channel.

FIG. 23 shows a bypass hydrocarbon trap 2300*a* comprising a sink mark channel 2300*a*. A close-up view 2300*b* of the sink mark channel 2302*b* is also shown. FIG. 24 shows a bypass hydrocarbon trap 2400 comprising a sink mark channel 2402.

Figure 25:
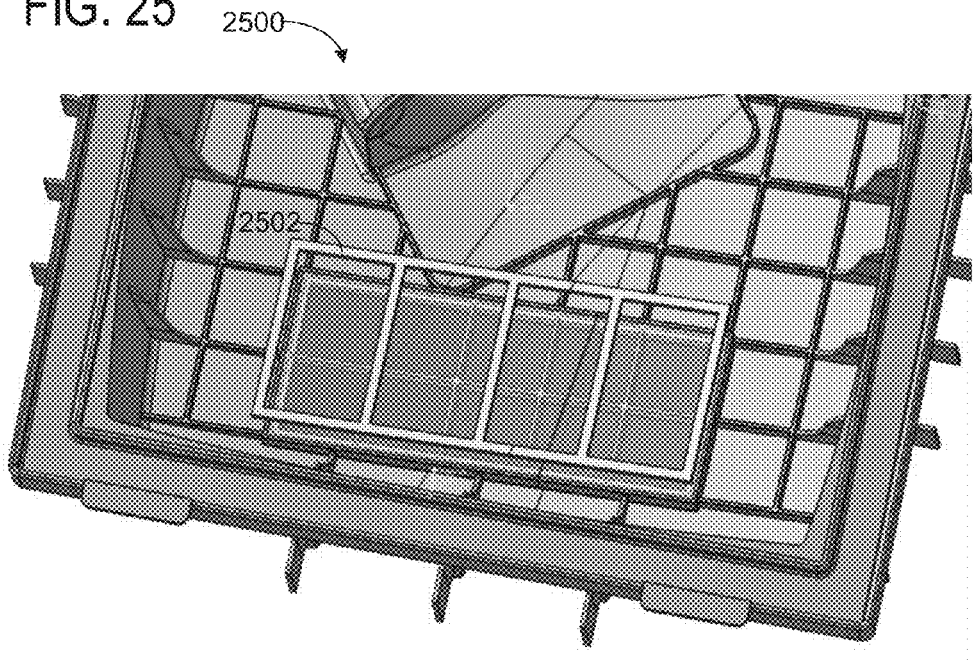
FIG. 25 shows a removable cover of the bypass hydrocarbon trap.
Figure 26:
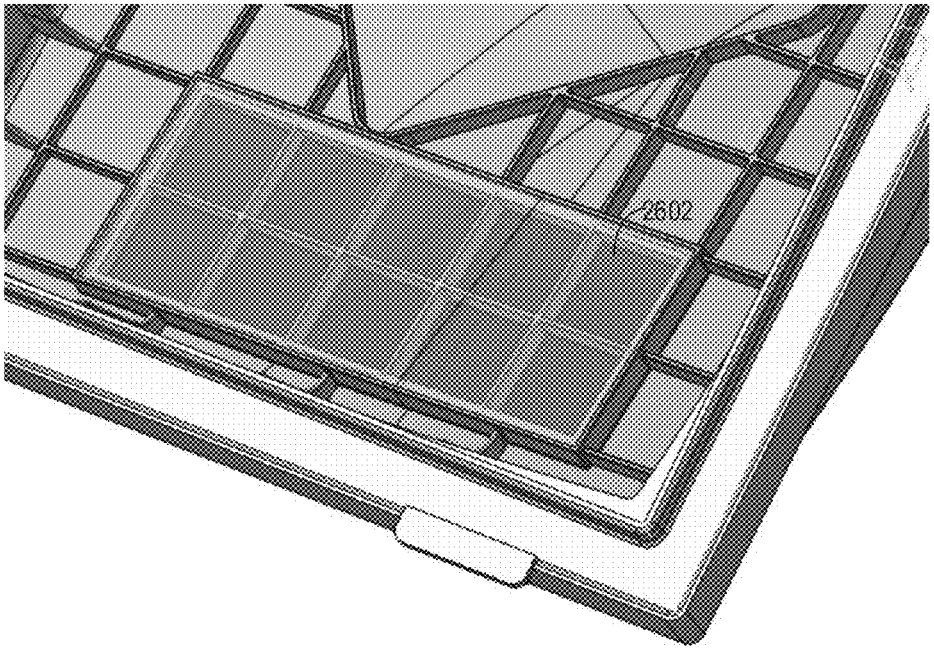
FIG. 26 shows a breathable layer of the bypass hydrocarbon trap.

FIG. 25 shows a bypass hydrocarbon trap 2500 comprising a removable lid (e.g., cover) 2502. The removable lid 2502 comprising orifices correspond ding to pockets of the bypass hydrocarbon trap 2500. FIG. 26 shows a bypass hydrocarbon trap 2600 with a breathable layer 2602. As shown, a removable lid is removed. In one embodiment, additionally or alternatively, the breathable layer and the removable lid may be a single piece.

Figure 27:
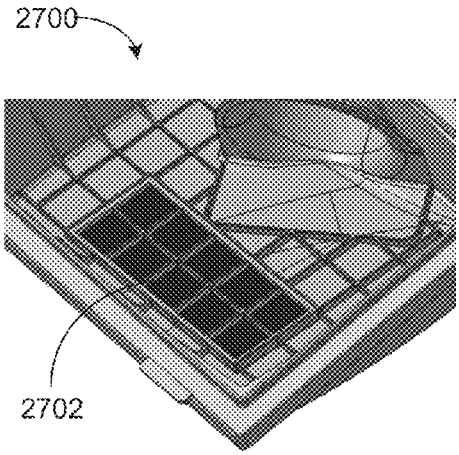
FIG. 27 shows a hydrocarbon trapping material located in one or more pockets of the bypass hydrocarbon trap.

FIG. 27 shows a bypass hydrocarbon trap 2700 comprising hydrocarbon trapping material 2702. As show, a removable lid and a breathable layer have been omitted from the bypass hydrocarbon trap. In this way, the hydrocarbon trapping material 2702 is free to flow out of one or more pockets of the bypass hydrocarbon trap 2700.

Figure 28:
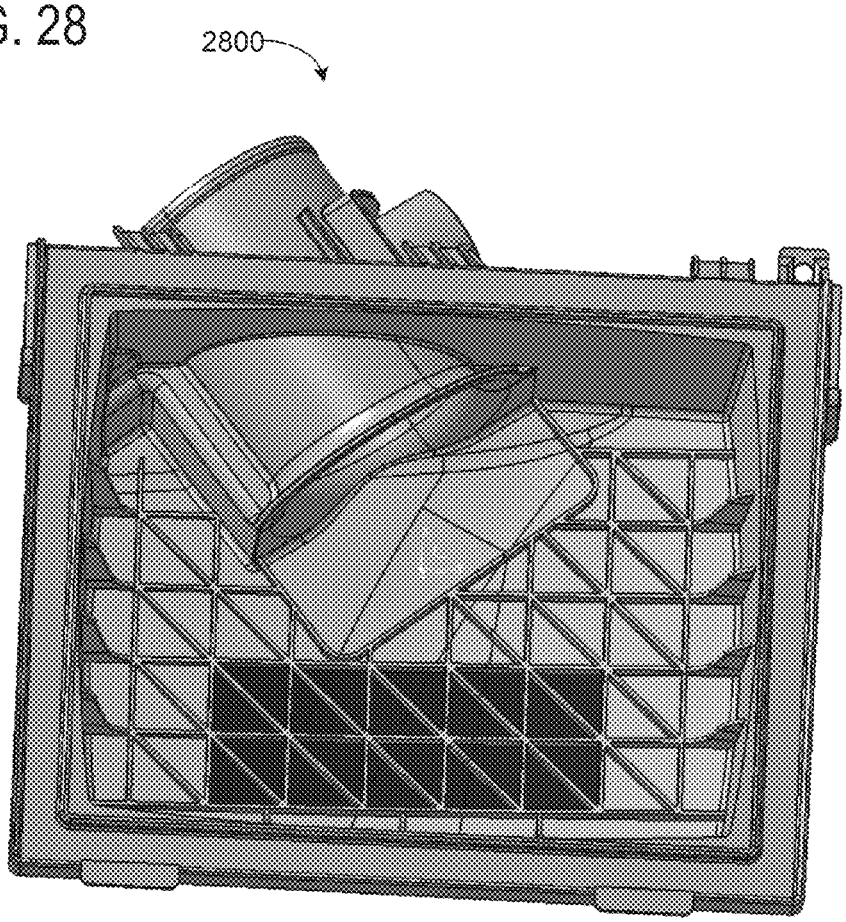
FIG. 28 shows triangle shaped pockets of the bypass hydrocarbon trap.
Figure 29:
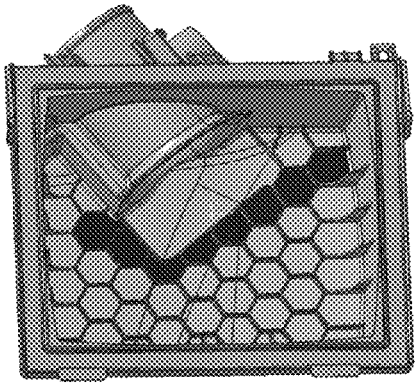
FIG. 29 shows hexagonal shaped pockets of the bypass hydrocarbon trap.
Figure 30:
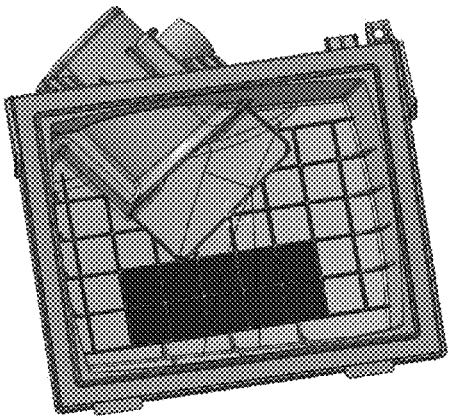
FIG. 30 shows square shaped pockets of the bypass hydrocarbon trap.
Figure 31:
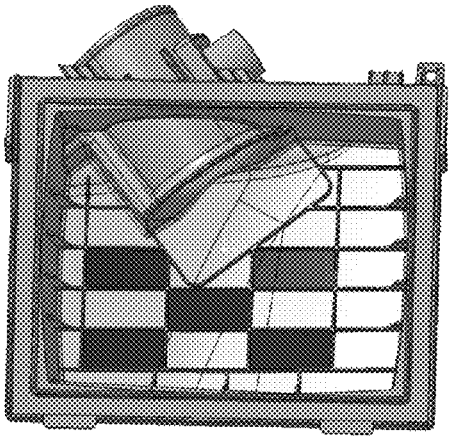
FIG. 31 shows rectangle shaped pockets of the bypass hydrocarbon trap.
Figure 32:
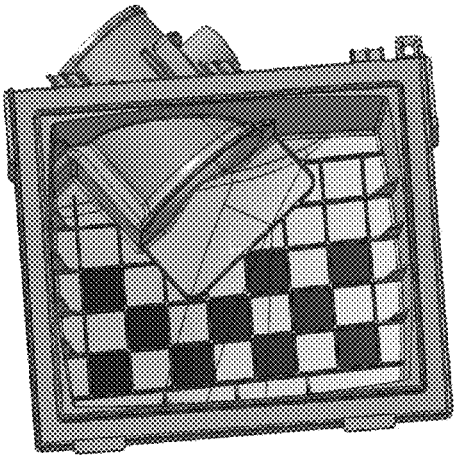
FIG. 32 shows square shaped pockets of the bypass hydrocarbon trap.
Figure 33:
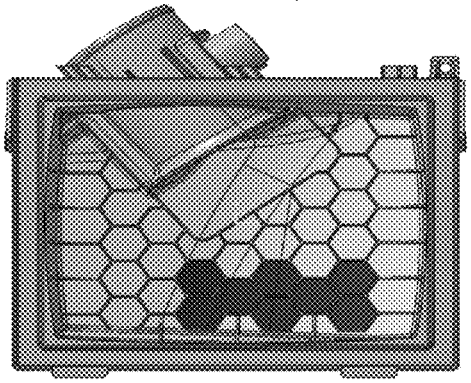
FIG. 33 shows hexagon shaped pockets of the bypass hydrocarbon trap.
Figure 34:
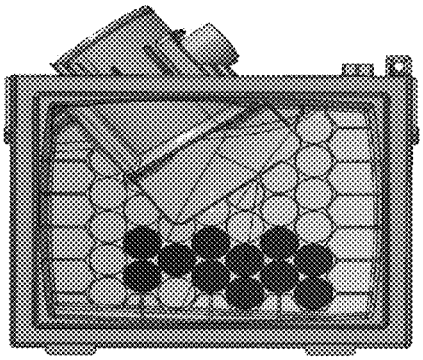
FIG. 34 shows circle shaped pockets of the bypass hydrocarbon trap.

FIGS. 28 to 34 shows various embodiments of a bypass hydrocarbon trap. FIG. 28 shows a bypass hydrocarbon trap 2800 comprising a plurality of triangle shaped pockets. FIG. 29 shows a bypass hydrocarbon trap 2900 comprising a plurality of hexagonal shaped pockets with an asymmetric fill pattern. FIG. 30 shows a bypass hydrocarbon trap 3000 comprising a plurality of square shaped pockets. FIG. 31 shows a bypass hydrocarbon trap 3100 comprising a plurality of rectangle shaped pockets. FIG. 32 shows a bypass hydrocarbon trap 3200 comprising a plurality of square shaped pockets in a different pattern than that of hydrocarbon trap 3000 of FIG. 30. FIG. 33 shows a bypass hydrocarbon trap 3300 comprising a plurality of hexagonal pockets with a symmetric fill pattern. FIG. 34 shows a bypass hydrocarbon trap 3400 comprising a plurality of circle shaped pockets. Thus, a variety of bypass hydrocarbon traps may be used dependent on a shape of a cavity of an intake conduit.

In this way, a hydrocarbon trap may be located in and utilize a shape of an intake manifold in order to prevent fuel vapors from escaping through the intake manifold during engine off operations. The hydrocarbon trap may be a variety of shapes based on a structure of the intake manifold. The hydrocarbon trap may be a hybrid hydrocarbon trap or a bypass hydrocarbon trap. The technical effect of including a hydrocarbon trap in the intake manifold is to mitigate fuel emissions through the intake during engine-off operating conditions.

In a first example, a system comprising an air box having an air filter, the air box having a hydrocarbon trap and a removable lid, and internal reinforcing structures creating one or more pockets, and a hydrocarbon trap material positioned within one or more of the pockets, the lid defining a boundary of the air flow passage, the air box including a layer coupled over the pockets.

In a first embodiment, the first example further comprising, additionally or alternatively, where the hydrocarbon trap is a bypass hydrocarbon trap.

In a second embodiment, which may additionally include the first embodiment, the first example further comprising where the layer is a breathable non-woven polyester material.

In a third embodiment, which may additionally include the first and second embodiments, the first example further comprising a cross-section area of the air flow passage is interrupted when transitioning into a section of the induction conduit having the bypass adsorption hydrocarbon trap coupled thereto.

In a fourth embodiment, which may additionally include one or more of the first to third embodiments, the first example further comprises where the internal reinforcing structure is one or more ribs extending perpendicularly from the base to the removable lid under the pockets.

In a fifth embodiment, which may additionally include one or more of the first to fourth embodiments, the first example further comprises where the base and the ribs comprise of a non-breathable material.

In a sixth embodiment, which may additionally include one or more of the first to fifth embodiments, the first example further comprises where a space between the internal reinforcing structure, a base, and the removable lid defines a volume of a single pocket.

In a seventh embodiment, which may additionally include one or more of the first to sixth embodiments, the first example further comprises where the hydrocarbon trap material is loosely packed into each of the pockets of the hydrocarbon trap.

In an eighth embodiment, which may additionally include one or more of the first to seventh embodiments, the first example further comprises where the removable lid rests upon the internal reinforcing structures with the layer located therebetween.

In a ninth embodiment, which may additionally include one or more of the first to eighth embodiments, the first example further comprises where the removable lid is coupled to the internal reinforcing structures along a periphery of the removable lid.

In a tenth embodiment, which may additionally include one or more of the first to ninth embodiments, the first example further comprises where the removable lid comprises a first layer and a second layer, where both layers are breathable and at least one of the layers is adhesive and able to bond to a top of the internal support structures.

In an eleventh embodiment, which may additionally include one or more of the first to tenth embodiments, the first example further comprises where the base and the internal reinforcing structures are non-breathable and do not allow a transfer of gases, liquids, and/or solids across membranes of the base and the internal reinforcing structures.

In a twelfth embodiment, which may additionally include one or more of the first to eleventh embodiments, the first example further comprises where the removable lid is contoured to be in face sharing contact with the internal reinforcing structures of the air box of the induction conduit.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

an air box having an air filter, the air box having a hydrocarbon trap and a removable lid, and internal reinforcing structures creating one or more pockets; and a hydrocarbon trap material positioned within one or more of the pockets, the lid defining a boundary of the air flow passage, the air box including a layer coupled over the pockets.

2. The system of claim 1, where the hydrocarbon trap is a bypass hydrocarbon trap.

3. The system of claim 1, where the layer is a breathable non-woven polyester material.

4. The system of claim 1, where a cross-section area of the air flow passage is interrupted when transitioning into a section of the induction conduit having the bypass adsorption hydrocarbon trap coupled thereto.

5. The system of claim 2, where the internal reinforcing structure is one or more ribs extending perpendicularly from a base to the removable lid under the pockets.

6. The system of claim 5, where the base and the ribs comprise of a non-breathable material.

7. The system of claim 1, where a space between the internal reinforcing structure, a base, and the removable lid defines a volume of a single pocket.

8. The system of claim 1, where the hydrocarbon trap material is loosely packed into each of the pockets of the hydrocarbon trap.

9. The system of claim 1, where the removable lid rests upon the internal reinforcing structures with the layer located therebetween.

10. The system of claim 1, where the removable lid is coupled to the internal reinforcing structures along a periphery of the removable lid.

11. The system of claim 1, where the removable lid comprises a first layer and a second layer, where both layers are breathable and at least one of the layers is adhesive and able to bond to a top of the internal support structures.

12. The system of claim 11, where the base and the internal reinforcing structures are non-breathable and do not allow a transfer of gases, liquids, and/or solids across membranes of the base and the internal reinforcing structures.

13. The system of claim 1, where the removable lid is contoured to be in face sharing contact with the internal reinforcing structures of the air box of the induction conduit.

14. A system, comprising:

an airflow induction conduit in fluidic communication with an engine intake and including a recessed cavity;

a bypass-adsorption hydrocarbon trap positioned within the cavity, forming a continuous, uninterrupted linear surface without sharp edges, ledges, or shelves, and defining a boundary of an airflow passage, the bypass-adsorption hydrocarbon trap including a hydrocarbon adsorption material located within one or more pockets; and a removable cover sitting on top of one or more ribs perpendicularly extending from a surface of the cavity, where a space located between the removable cover, the ribs, and the surface of the cavity defines a volume of an individual pocket of the bypass adsorption hydrocarbon trap.

15. The system of claim 14, where the bypass hydrocarbon trap comprises a plurality of the individual pockets, and where the individual pockets comprise an amount of hydrocarbon trapping material.

16. The system of claim 14, where the removable lid is breathable and allows gas to enter the space of the pocket.

17. The system of claim 14, where the surface of the cavity and the ribs are non-breathable and gas does not pass through the ribs or the surface of the cavity.

18. The system of claim 14, where the removable cover is coupled to one or more of the ribs and the surface of the cavity along a periphery of the removable cover.

19. A system, comprising:

an air box having an air filter, the air box having a hydrocarbon trap and a removable lid, and internal reinforcing structures creating a plurality of pockets; and a hydrocarbon trap material positioned within some, but not all, of the pockets, the lid defining a boundary of the air flow passage, the air box including a layer coupled over the pockets.

* * * * *